US011628465B1

(12) United States Patent
Hong

(10) Patent No.: US 11,628,465 B1
(45) Date of Patent: Apr. 18, 2023

(54) CUTTER

(71) Applicant: SIANG SYUAN FU ENTERPRISE CO., LTD., Changhua County (TW)

(72) Inventor: Han-Lin Hong, Changhua County (TW)

(73) Assignee: SIANG SYUAN FU ENTERPRISE CO., LTD., Changhua County (TW)

( * ) Notice: Subject to any disclaimer, the term of this patent is extended or adjusted under 35 U.S.C. 154(b) by 0 days.

(21) Appl. No.: 17/524,975

(22) Filed: Nov. 12, 2021

(51) Int. Cl.
*B05C 17/01* (2006.01)
*B05C 17/005* (2006.01)

(52) U.S. Cl.
CPC .... *B05C 17/0143* (2013.01); *B05C 17/00593* (2013.01)

(58) Field of Classification Search
CPC ..... B05C 17/0143; B05C 17/00593
See application file for complete search history.

(56) References Cited

U.S. PATENT DOCUMENTS 3,105,614 A * 10/1963 Sherbondy ..... B05C 17/0123 222/391
3,189,226 A * 6/1965 Sherbondy ..... B05C 17/0143 222/391
4,135,644 A * 1/1979 Pacetti ..... B05C 17/0143 222/326
4,390,115 A * 6/1983 Bigham ..... B05C 17/0143 222/326
4,493,437 A * 1/1985 Breeden ..... B05C 17/0143 222/82
4,802,607 A * 2/1989 Johnson ..... B67B 7/44 222/326
5,815,925 A * 10/1998 Chang ..... B05C 17/01 222/326
5,860,568 A * 1/1999 Mallalieu ..... B67B 7/30 222/326
6,056,156 A * 5/2000 Peng ..... B26D 3/162 222/326
2005/0023301 A1* 2/2005 Rumrill ..... B05C 17/01 222/391
2006/0162169 A1* 7/2006 Whitemiller ..... B26D 3/02 30/182
2006/0163280 A1* 7/2006 Murray ..... B05C 17/00503 222/81
2013/0160621 A1* 6/2013 Marsden ..... B05C 17/0123 222/83.5

* cited by examiner

*Primary Examiner* — Donnell A Long
(74) *Attorney, Agent, or Firm* — Muncy, Geissler, Olds & Lowe, P.C.

(57) ABSTRACT

A cutter and a caulking gun having the same are provided. The cutter is configured to be connected to a caulking gun having a connecting member which is disposed on the caulking gun and includes a first assembling portion. The cutter includes a main body including a base and a cutting portion connected with the base, the cutting portion includes a cutting blade, and the base includes a second assembling portion configured to be detachably connected with the first assembling portion.

9 Claims, 11 Drawing Sheets

CUTTER

BACKGROUND OF THE INVENTION

Field of the Invention

The present invention relates to a cutter.

Description of the Prior Art

A cutting member such as utility knife, scissors, or cutter is often used to cut off part of a tubular member. For example, the nozzle of a container containing a caulking material needs to be cut before it can be used. Therefore, a kind of caulking gun with a cutter disposed on a rear end of a push rod is provided, for facilitating cutting of the tubular member. However, the conventional caulking gun provided with the cutter on the push rod has a large length and large size, which results in problems of inconvenient storage and operation.

The present invention is, therefore, arisen to obviate or at least mitigate the above-mentioned disadvantages.

SUMMARY OF THE INVENTION

The main object of the present invention is to provide a cutter and a caulking gun having the same, wherein it is optional to mount or detach the cutter.

To achieve the above and other objects, a cutter is provided. The cutter is configured to be connected to a caulking gun having a connecting member which is disposed on the caulking gun and includes a first assembling portion. The cutter includes a main body including a base and a cutting portion connected with the base, the cutting portion includes a cutting blade, and the base includes a second assembling portion configured to be detachably connected with the first assembling portion.

To achieve the above and other objects, a caulking gun is further provided, including a cutter of claim 1, further including: a gun body, including a carrier and a handle, the carrier being configured for installation of a cartridge; a push rod, movably disposed on the gun body, an end of the push rod being configured to push the cartridge, another end of the push rod including a rear portion, the rear portion and the carrier being located at two opposing sides of the handle; and the connecting member, disposed on the rear portion; wherein the base is configured to be detachably connected with the first assembling portion by the second assembling portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
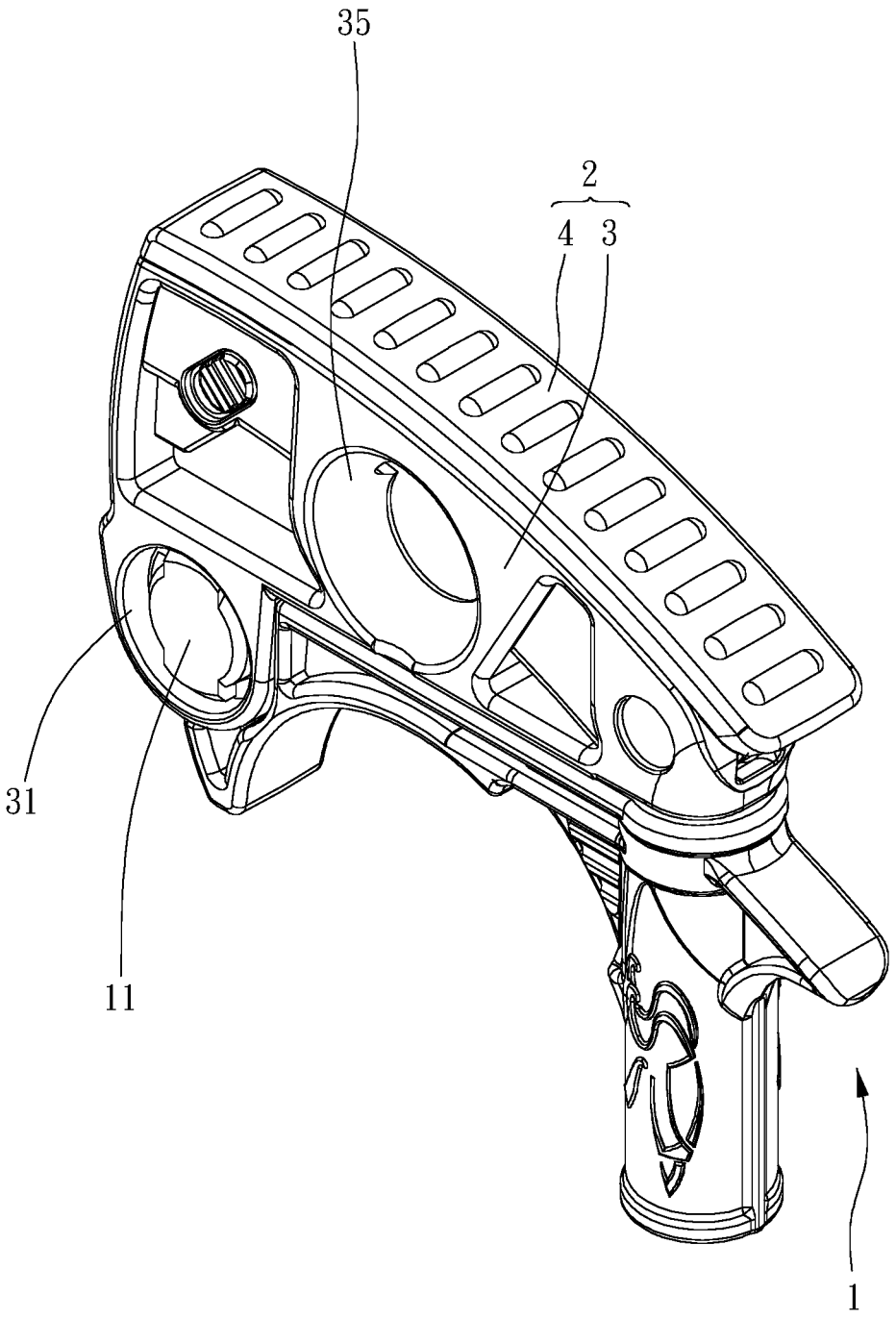
FIG. 1 is a stereogram of a cutter of a preferable embodiment of the present invention.
Figure 2:
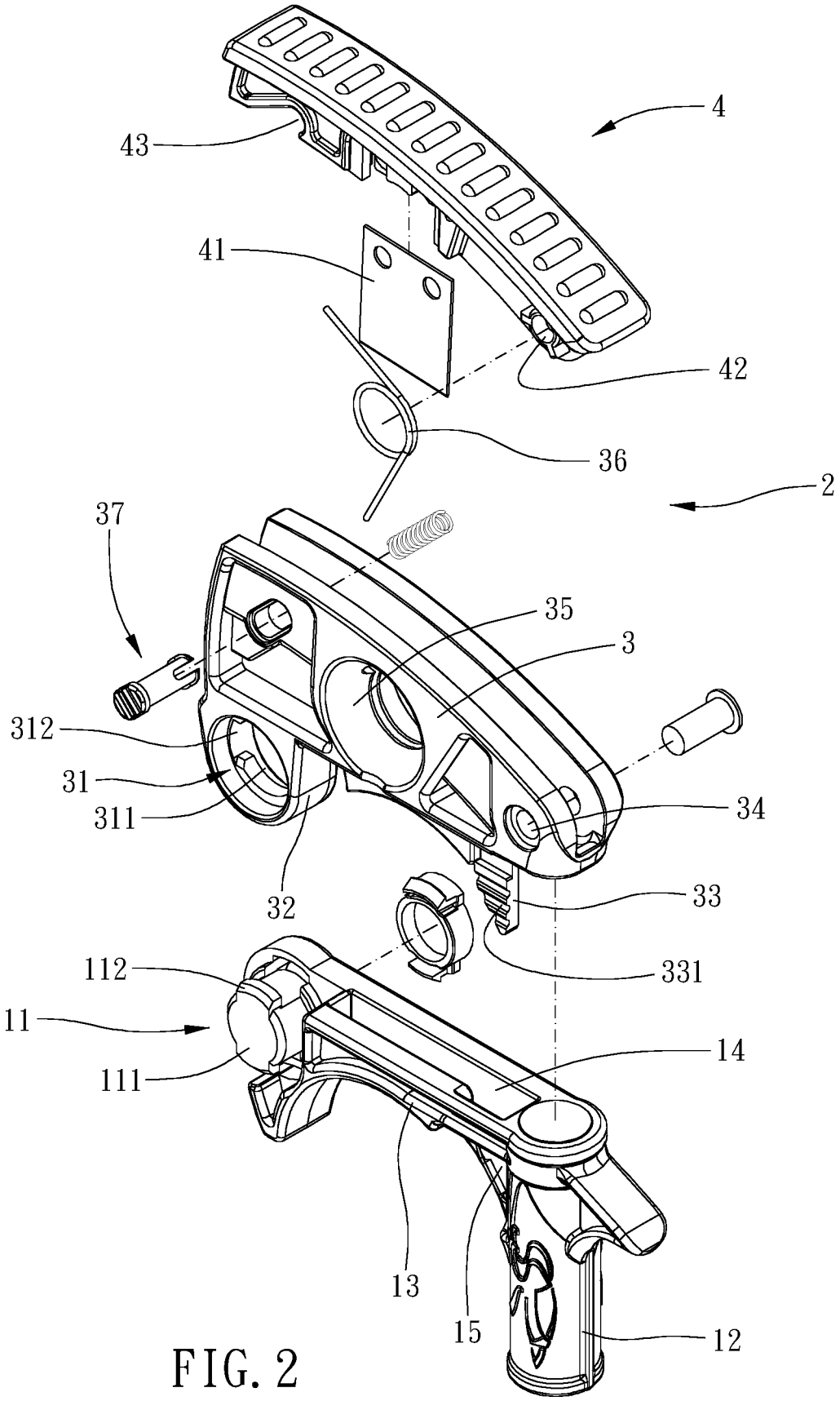
FIGS. 2 and 3 are breakdown drawings of the cutter of a preferable embodiment of the present invention.
Figure 3:
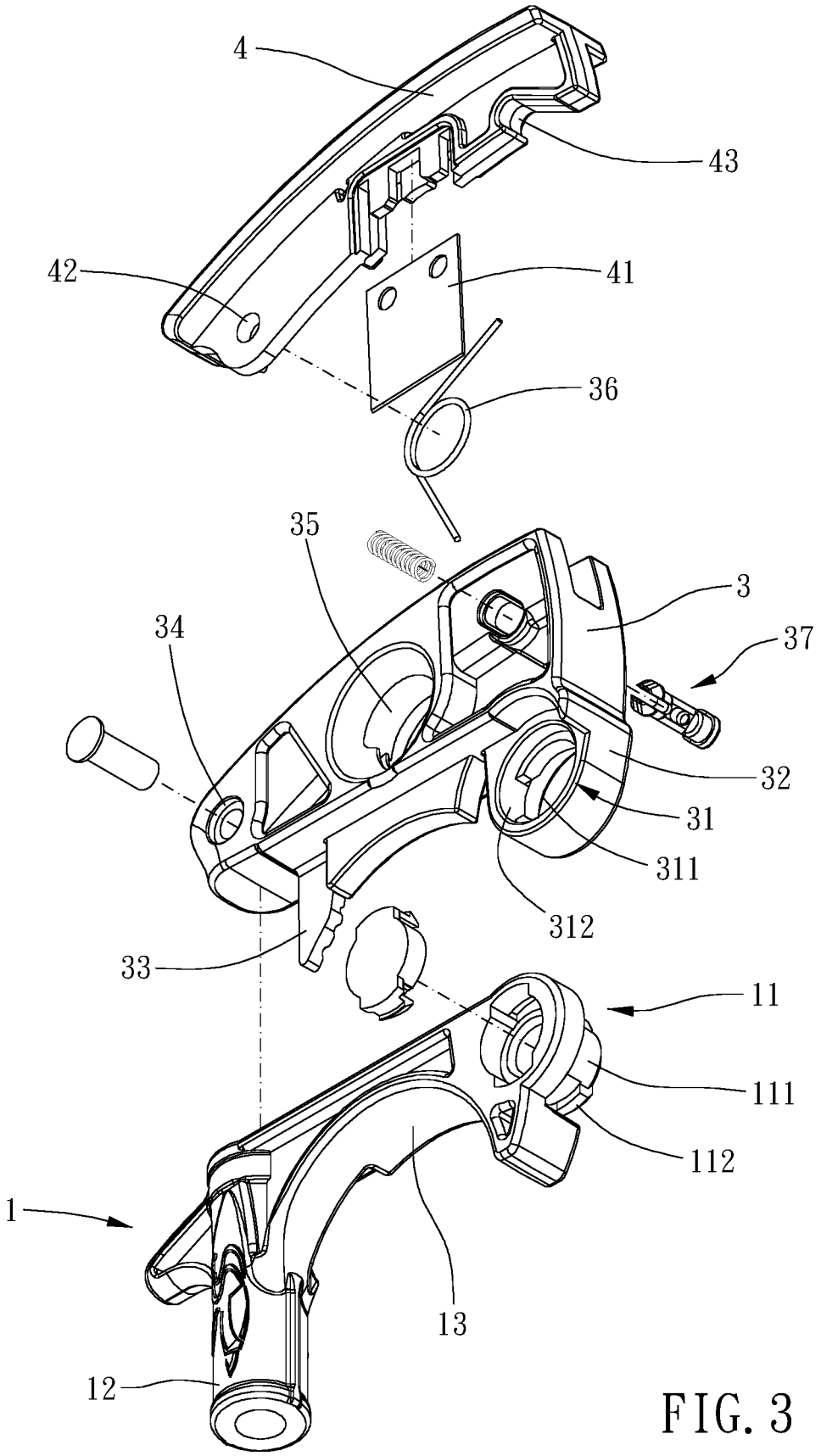
Figure 4:
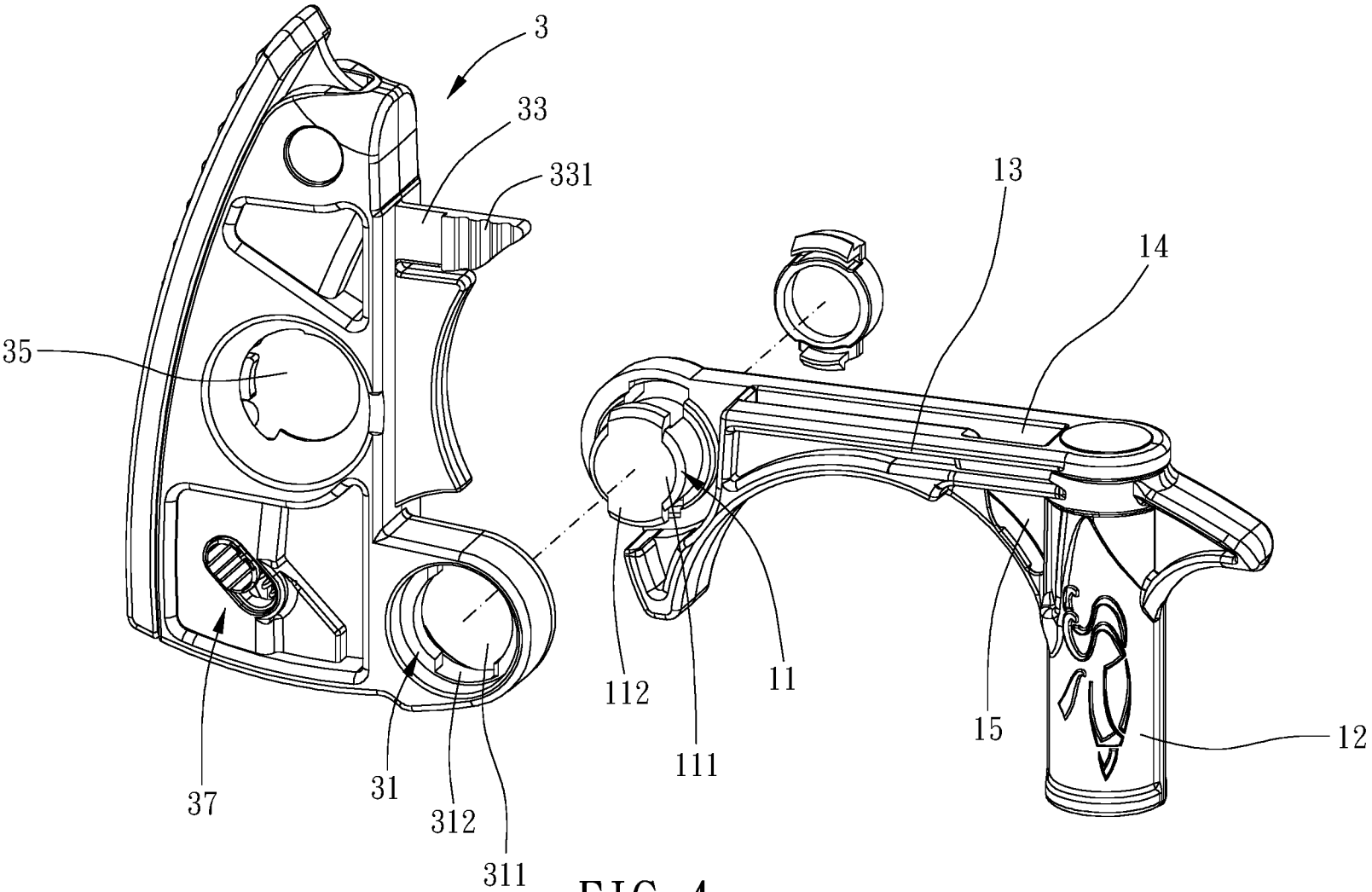
FIGS. 4 and 5 are drawings showing assembling of the cutter according to a preferable embodiment of the present invention.
Figure 5:
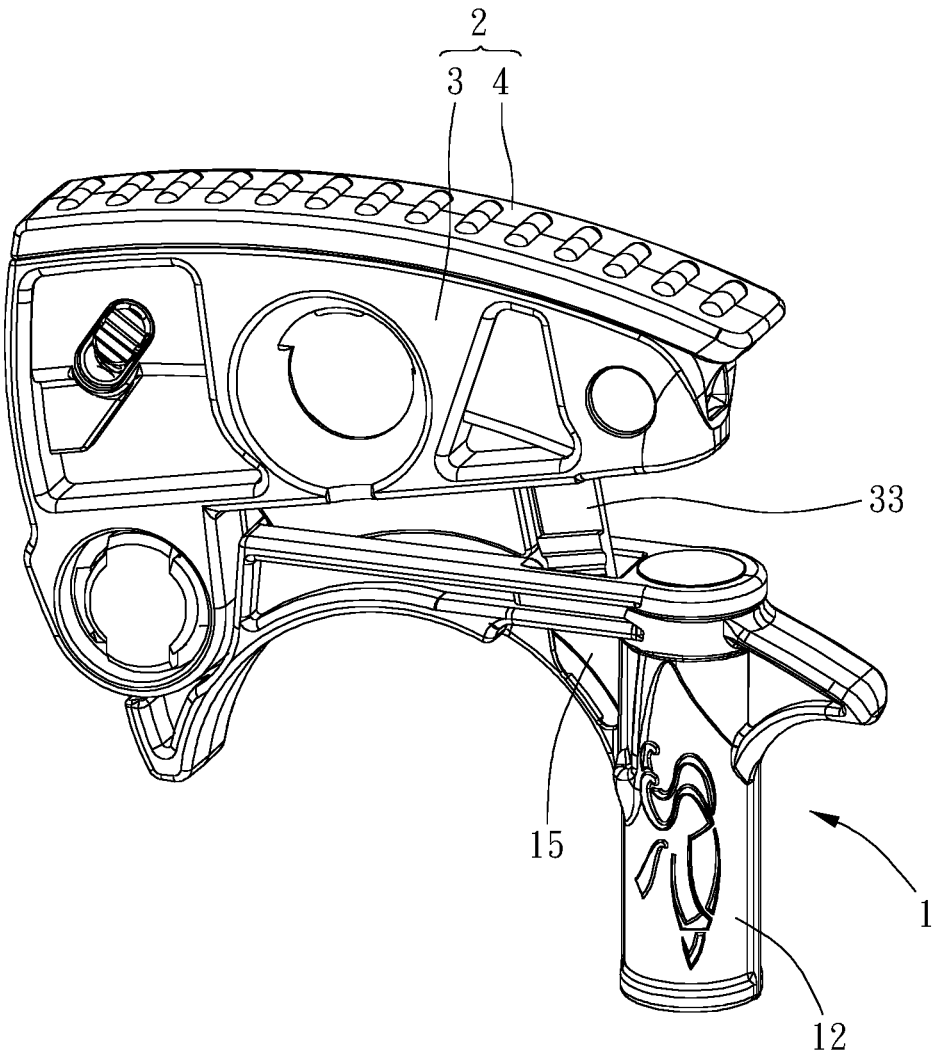

Please refer to FIGS. 1 to 11 for a preferable embodiment of the present invention. A cutter 2 of the present invention is configured to be connected to a caulking gun having a connecting member 1 which is disposed on the caulking gun and includes a first assembling portion 11. The cutter 2 includes a main body.

The main body includes a base 3 and a cutting portion 4 connected with the base 3, the cutting portion 4 includes a cutting blade 41, and the base 3 includes a second assembling portion 31 configured to be detachably connected with the first assembling portion 11.

It is optional to mount the cutter 2 to the connecting portion 12 or to detach the cutter 2 from the connecting portion 12 depending on requirements in various working environments, and the cutter 2 can be detached from the connecting portion 12 for use or storage.

Specifically, the caulking gun includes a push rod 93, the push rod 93 includes a rear portion 94, the connecting member 1 includes a connecting portion 12 and an extension section 13, and the connecting portion 12 is configured to be connected to the rear portion 94. An extension direction of the push rod 93 is defined as a first direction L1, the extension section 13 extends in a second direction L2 lateral to the first direction L1, a third direction L3 is defined as to be lateral to the first direction L1 and the second direction L2, and the first assembling portion 11 is disposed on an end of the extension section 13 remote from the connecting portion 12.

In this embodiment, the first assembling portion 11 and the second assembling portion 31 are pivoted with each other, and the second assembling portion 31 is rotatable relative to the first assembling portion 11 about the third direction L3 between a first position and a second position. When the second assembling portion 31 is located in the first position, the second assembling portion 31 is not disengageable from the first assembling portion 11. When the second assembling portion 31 rotates to be in the second position, the second assembling portion 31 is disengageable from the first assembling portion 11. As a result, the cutter 2 can be secured to or detached from the connecting member 1 by rotation of the cutter 2 relative to the connecting member 1.

Specifically, one of the first assembling portion 11 and the second assembling portion 31 includes a shaft 111, the other of the first assembling portion 11 and the second assembling portion 31 includes a hole 311, and the shaft 111 is rotatably inserted within the hole 311. The shaft 111 includes at least one projection 112 projecting radially, and a hole wall of the hole 311 includes at least one recess 312. When the second assembling portion 31 is located in the first position, each of the at least one projection 112 does not correspond to the at least one recess 312 such that the shaft 111 is not disengageable axially form the hole 311. When the second assembling portion 31 is located in the second position, each of the at least one projection 112 correspond to the at least one recess 312 such that the shaft 111 is disengageable axially form the hole 311.

Preferably, the base 3 further includes an ear portion 32 extending in the first direction L1, and the ear portion 32 includes the second assembling portion 31. When the second assembling portion 31 is located in the first position, the base 3 is abutted against the extension section 13, which reduces an entire length of the push rod 93 and the cutter 2.

One of the base 3 and the connecting member 1 includes an engaging member 33, the other of the base 3 and the connecting member 1 includes an engaging slot 14, and the engaging member 33 includes a plurality of engaging protrusions 331 which are detachably engaged within the engaging slot 14. In this embodiment, the base 3 includes the engaging member 33, and the connecting member 1 includes the engaging slot 14. When the second assembling portion 31 is located in the first position, the engaging member 33 is engaged within the engaging slot 14 to prevent the cutter 2 from detaching from the connecting member 1 due to that the second assembling portion 31 rotates to be in the second position.

Figure 6:
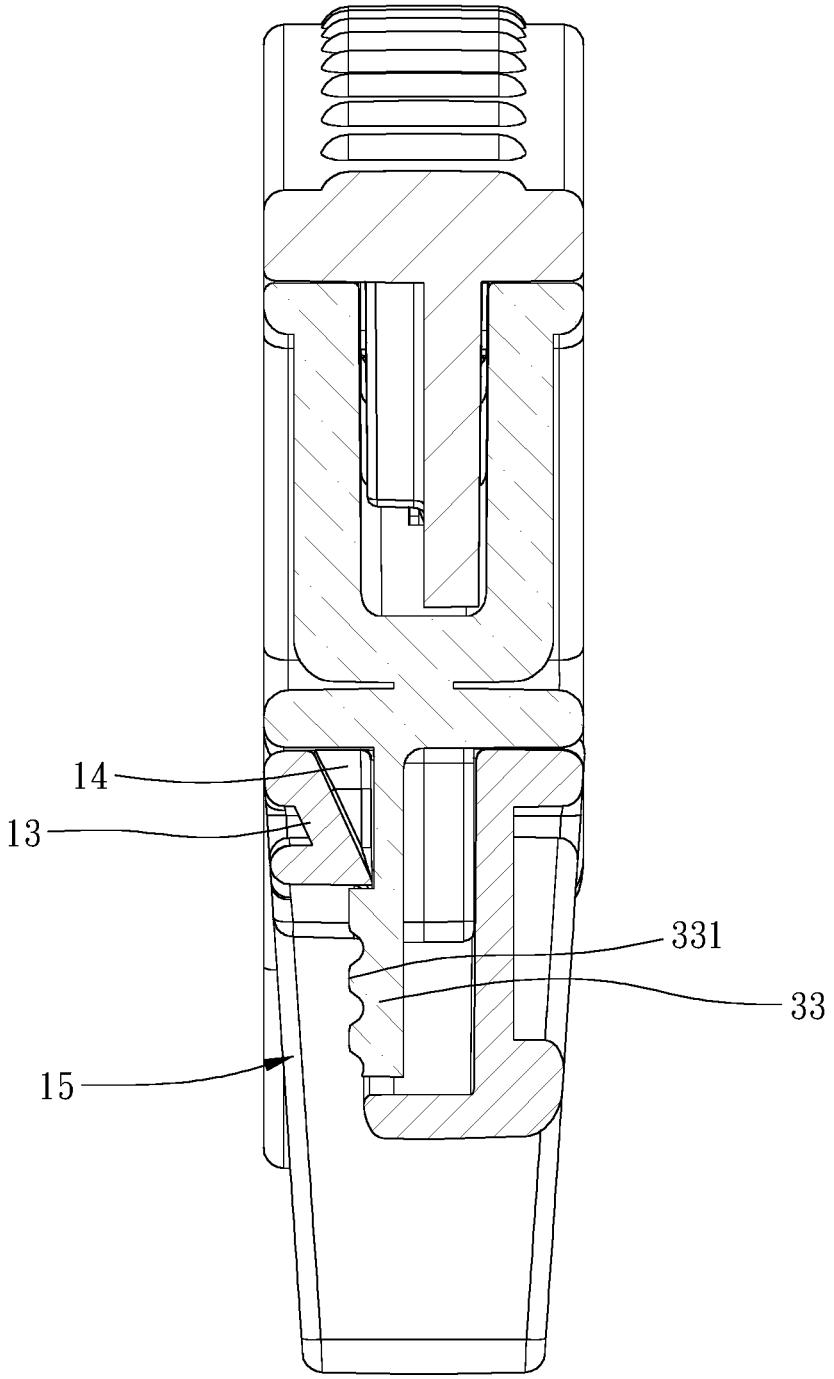
FIGS. 6 and 7 are cross-sectional views showing operation of an engaging member according to a preferable embodiment of the present invention.
Figure 7:
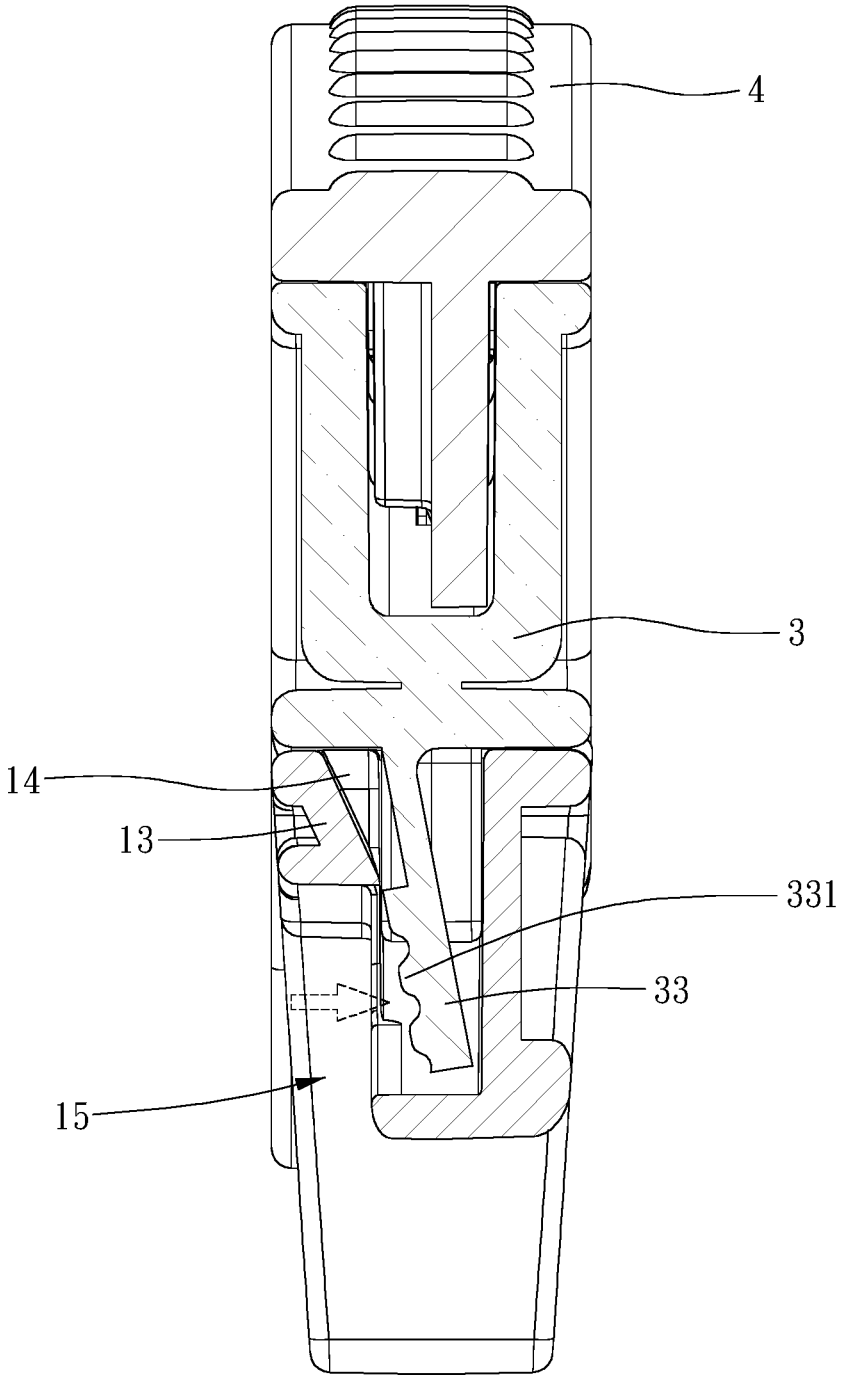
Figure 8:
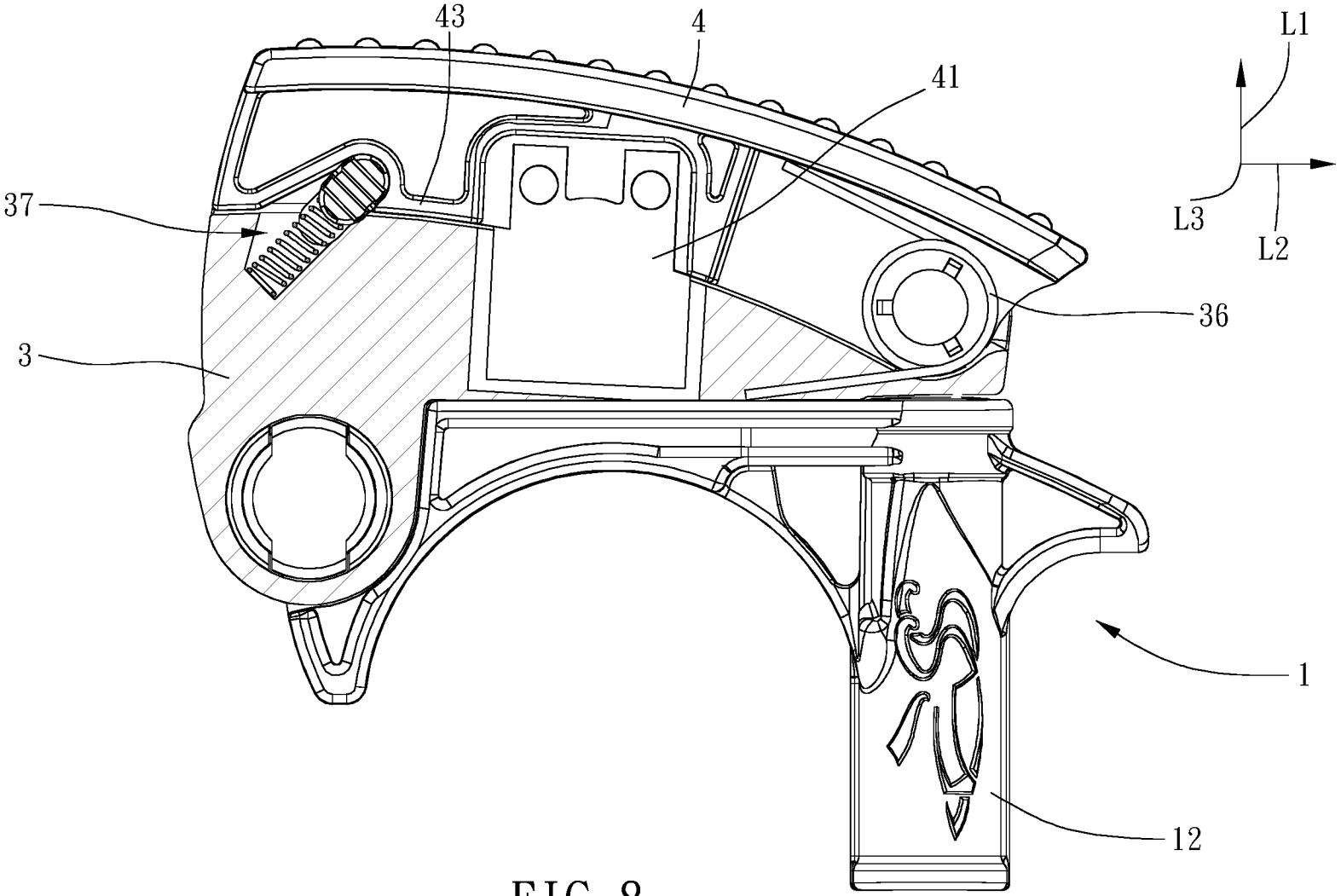
FIGS. 8 to 10 are cross-sectional views showing operation of an elastic buckling member according to a preferable embodiment of the present invention.
Figure 9:
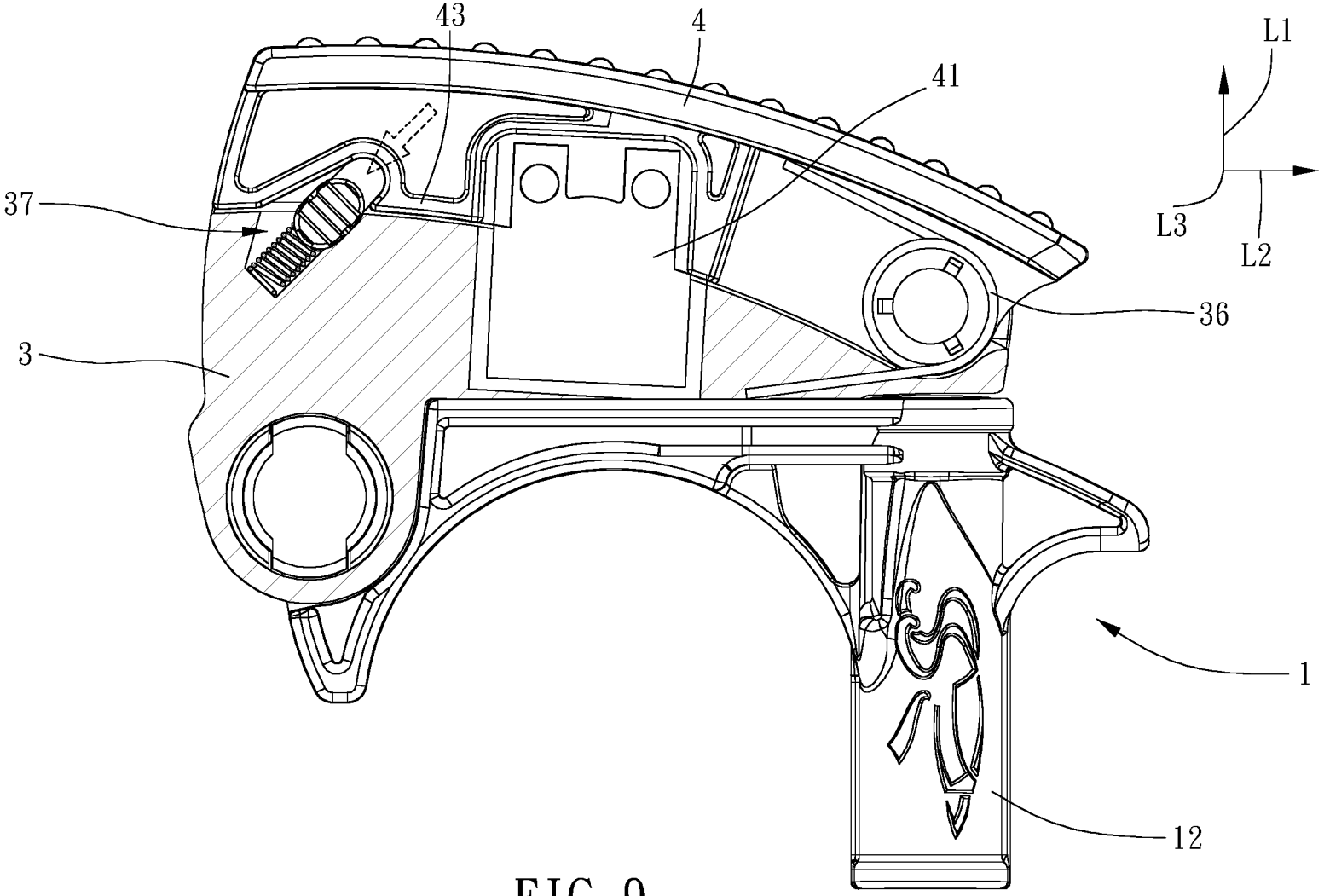
Figure 10:
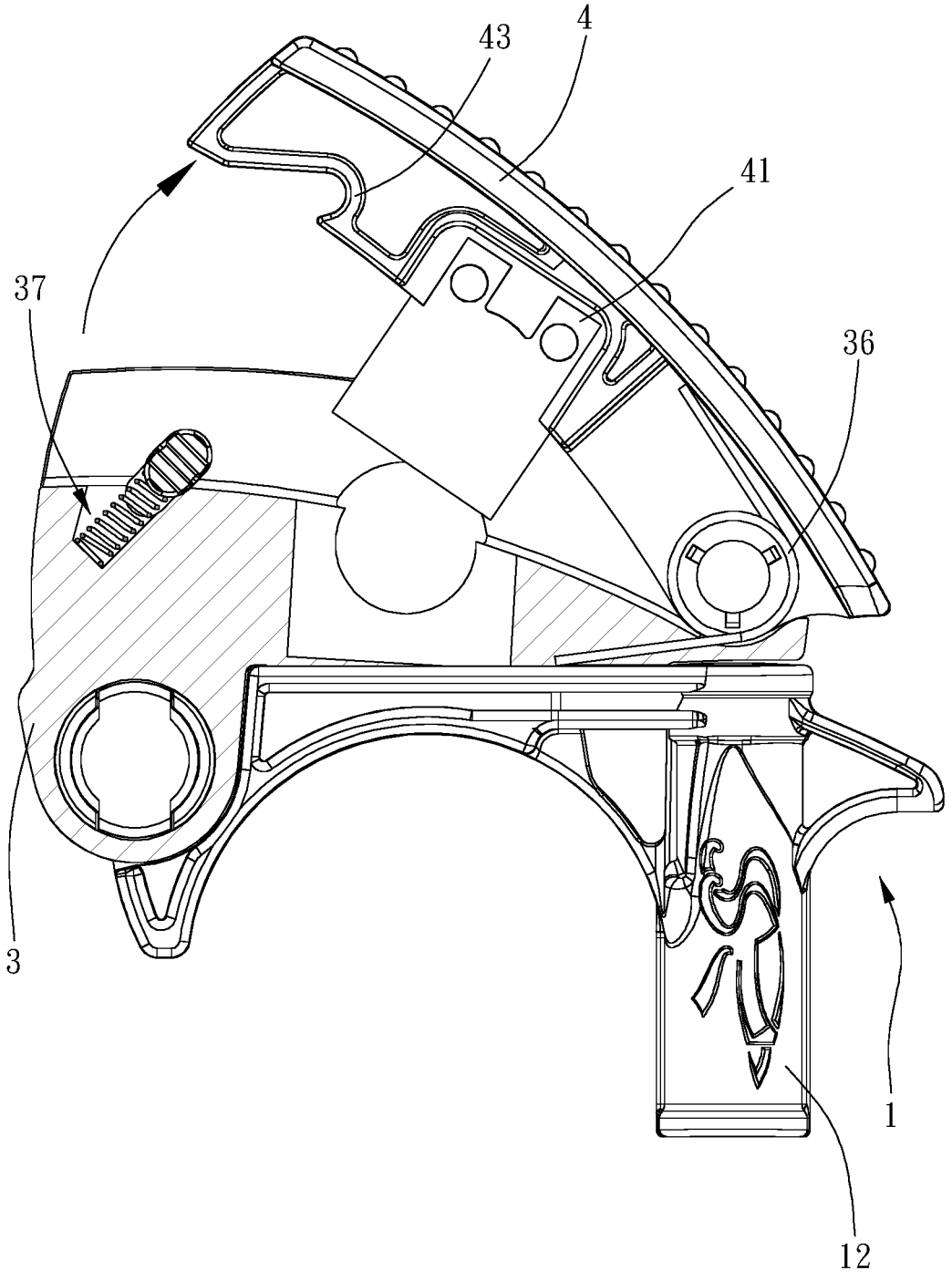
Figure 11:
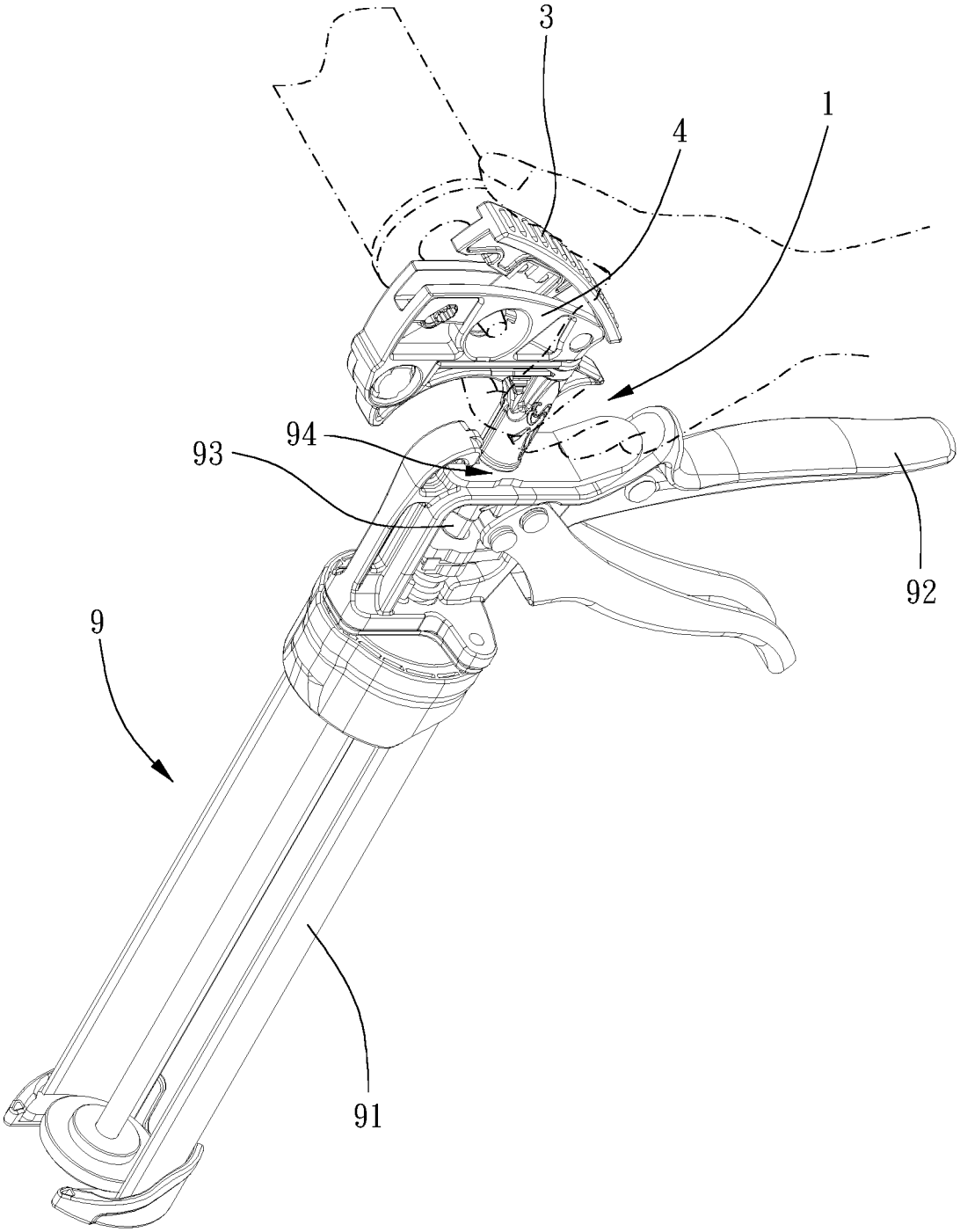
FIG. 11 is a drawing showing a caulking gun having a cutter according to a preferable embodiment of the present invention.

The engaging slot 14 is disposed on the extension section 13 and extends in the first direction L1, and the extension section 13 further includes a hollowed portion 15 along the third direction L3. When the engaging member 33 is engaged within the engaging slot 14, the engaging member 33 corresponds to the hollowed portion 15, so that the engaging member 33 can be pressed easily to make the engaging member 33 be not engaged within the engaging slot 14 (FIGS. 6 and 7).

An end of the base 3 remote from the second assembling portion 31 includes a first pivoting portion 34, the cutting portion 4 further includes a second pivoting portion 42 pivoted with the first pivoting portion 34, and the cutting portion 4 further includes a through hole 35. When the cutting portion 4 swings relative to the base 3, a part of the cutting blade 41 passes through the through hole 35 so that an object inserted within the through hole 35 can be cut off by the cutting blade 41 through pressing the cutting portion 4.

Preferably, the cutter 2 further includes an elastic member 36, the elastic member 36 is abutted between the base 3 and the cutting portion 4, for recovering the cutting portion 4 after the cutting portion 4 is pressed. The base 3 further includes an elastic buckling member 37, and an end of the cutting portion 4 remote from the second pivoting portion 42 includes a hook 43. When the cutting portion 4 covers the base 3, the elastic buckling member 37 is blocked by the hook 43, thus compacting the volume of the cutter 2 and avoiding damage caused by the cutting blade 41.

A caulking gun is further provided. The caulking gun includes the cutter 2, and the caulking gun further includes a gun body 9, a push rod 93 and the connecting member 1. The gun body 9 includes a carrier 91 and a handle 92, and the carrier 91 is configured for installation of a cartridge. The push rod 93 is movably disposed on the gun body 9, an end of the push rod 93 is configured to push the cartridge, another end of the push rod 93 includes a rear portion 94, and the rear portion 94 and the carrier 91 are located at two opposing sides of the handle 92. The connecting member 1 is disposed on the rear portion 94. The base 3 is configured to be detachably connected with the first assembling portion 11 by the second assembling portion 31.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A cutter, configured to be connected to a caulking gun having a connecting member which is disposed on the caulking gun and includes a first assembling portion, including:

a main body, including a base and a cutting portion connected with the base, the cutting portion including a cutting blade, the base including a second assembling portion configured to be detachably connected with the first assembling portion;

wherein the caulking gun includes a push rod, the push rod includes a rear portion, the connecting member includes a connecting portion and an extension section, the connecting portion is configured to be connected to the rear portion, an extension direction of the push rod is defined as a first direction, the extension section extends in a second direction lateral to the first direction, a third direction is defined as to be lateral to the first direction and the second direction, and the first assembling portion is disposed on an end of the extension section remote from the connecting portion.

2. The cutter of claim 1, wherein the first assembling portion and the second assembling portion are pivoted with each other, the second assembling portion is rotatable relative to the first assembling portion about the third direction between a first position and a second position, when the second assembling portion is located in the first position, the second assembling portion is not disengageable from the first assembling portion, and when the second assembling portion rotates to be in the second position, the second assembling portion is disengageable from the first assembling portion.

3. The cutter of claim 2, wherein one of the first assembling portion and the second assembling portion includes a shaft, the other of the first assembling portion and the second assembling portion includes a hole, the shaft is rotatably inserted within the hole, the shaft includes at least one projection projecting radially, a hole wall of the hole includes at least one recess, when the second assembling portion is located in the first position, each of the at least one projection does not correspond to the at least one recess such that the shaft is not disengageable axially form the hole, and when the second assembling portion is located in the second position, each of the at least one projection correspond to the at least one recess such that the shaft is disengageable axially form the hole.

4. The cutter of claim 3, wherein the base further includes an ear portion extending in the first direction, the ear portion includes the second assembling portion, and when the second assembling portion is located in the first position, the base is abutted against the extension section; one of the base and the connecting member includes an engaging member, the other of the base and the connecting member includes an engaging slot, and the engaging member includes a plurality of engaging protrusions which are detachably engaged within the engaging slot; the engaging slot is disposed on the extension section and extends in the first direction, the extension section further includes a hollowed portion along the third direction, and when the engaging member is engaged within the engaging slot, the engaging member corresponds to the hollowed portion; an end of the base remote from the second assembling portion includes a first pivoting portion, the cutting portion further includes a second pivoting portion pivoted with the first pivoting portion, the cutting portion further includes a through hole, and when the cutting portion swings relative to the base, a part of the cutting blade passes through the through hole; the cutter further includes an elastic member, the elastic member is abutted between the base and the cutting portion; the base further includes an elastic buckling member, an end of the cutting portion remote from the second pivoting portion includes a hook, and when the cutting portion covers the base, the elastic buckling member is blocked by the hook.

5. The cutter of claim 2, wherein the base further includes an ear portion extending in the first direction, the ear portion includes the second assembling portion, and when the second assembling portion is located in the first position, the base is abutted against the extension section.

6. The cutter of claim 1, wherein one of the base and the connecting member includes an engaging member, the other of the base and the connecting member includes an engaging slot, and the engaging member includes a plurality of engaging protrusions which are detachably engaged within the engaging slot.

7. The cutter of claim 6, wherein the engaging slot is disposed on the extension section and extends in the first direction, the extension section further includes a hollowed portion along the third direction, and when the engaging member is engaged within the engaging slot, the engaging member corresponds to the hollowed portion.

8. A caulking gun, including a cutter of claim 1, further including:

a gun body, including a carrier and a handle, the carrier being configured for installation of a cartridge;

the push rod, movably disposed on the gun body, an end of the push rod being configured to push the cartridge, another end of the push rod including the rear portion, the rear portion and the carrier being located at two opposing sides of the handle; and the connecting member, disposed on the rear portion;

wherein the base is configured to be detachably connected with the first assembling portion by the second assembling portion.

9. A cutter, configured to be connected to a caulking gun having a connecting member which is disposed on the caulking gun and includes a first assembling portion, including:

a main body, including a base and a cutting portion connected with the base, the cutting portion including a cutting blade, the base including a second assembling portion configured to be detachably connected with the first assembling portion;

wherein an end of the base remote from the second assembling portion includes a first pivoting portion, the cutting portion further includes a second pivoting portion pivoted with the first pivoting portion, the cutting portion further includes a through hole, and when the cutting portion swings relative to the base, a part of the cutting blade passes through the through hole.

* * * * *